United States Patent [19]

Kanda et al.

[11] Patent Number: 4,758,095

[45] Date of Patent: Jul. 19, 1988

[54] DUAL SHAFT PAN MIXER

[75] Inventors: Mamoru Kanda, Tokyo; Teruo Udagawa; Kathuichi Numagami, both of Fukaya, all of Japan

[73] Assignees: Chichibu Cement Kabushiki Kaisha; Chichibu Engineering Kabushiki Kaisha, both of Saitama, Japan

[21] Appl. No.: 69,448

[22] PCT Filed: Feb. 27, 1987

[86] PCT No.: PCT/JP87/00128

§ 371 Date: May 26, 1987

§ 102(e) Date: May 26, 1987

[87] PCT Pub. No.: WO87/05256

PCT Pub. Date: Sep. 11, 1987

[30] Foreign Application Priority Data

Feb. 28, 1986 [JP] Japan ..... 61-43490

[51] Int. Cl.[4] ..... B01F 7/04; B01F 11/00

[52] U.S. Cl. ..... 366/66; 366/128; 366/194; 366/300; 222/200

[58] Field of Search ..... 366/64, 66, 67, 77, 366/97, 113, 118, 123, 128, 189, 192, 297, 300, 301, 309, 194–196; 222/196, 198, 200

[56] References Cited

U.S. PATENT DOCUMENTS

| | | | |
|---|---|---|---|
| 2,178,881 | 11/1939 | Roeth | 366/123 |
| 3,271,012 | 9/1966 | Van Bael | 366/128 X |
| 3,370,758 | 2/1968 | Bodine | 222/196 |
| 4,148,588 | 4/1979 | Kanda et al. | 366/56 |
| 4,411,560 | 10/1983 | McComb | 222/200 X |
| 4,572,674 | 2/1986 | Mathis et al. | 366/192 |

FOREIGN PATENT DOCUMENTS

| | | | |
|---|---|---|---|
| 17946 | 4/1982 | Japan | 366/192 |
| 174935 | 8/1986 | Japan | 366/128 |

*Primary Examiner*—Harvey C. Hornsby
*Assistant Examiner*—S. Gerrity
*Attorney, Agent, or Firm*—Bruce L. Adams; Van C. Wilks

[57] ABSTRACT

A dual shaft pan mixer comprises a mixing vessel (1) having a first and a second pan section (3 and 4), a pair of paddle assemblies (10) having drive shafts (13) which are disposed horizontally and in paralllel relationship with each other within the mixing vessel (1) and adapted to rotate in mutually opposite directions, and a drive source (20) for synchronously driving the pair of paddle assemblies (10). The mixing vessel (1) includes a substantially triangular space (22) below an area intermediate the first and the second pan section and displaced out of the loci of rotation of the paddle assemblies (10), and also includes a discharge port (5) which is disposed adjacent to the space (22). The mixer also comprises a rod-shaped vibration generator (30) disposed within the space (22) and extending in a direction parallel to the drive shafts (13).

4 Claims, 3 Drawing Sheets

DUAL SHAFT PAN MIXER

FIELD OF THE INVENTION

The invention relates to a dual shaft pan mixer which is preferred for use in mixing concrete material, while not limited thereto, and more particularly, to a dual shaft pan mixer having a pair of paddle assemblies which are disposed horizontally and in parallel relationship with each other within a mixing vessel and rotating in opposite directions.

DESCRIPTION OF THE PRIOR ART

A dual shaft pan mixer can be used for mixing a relatively large volume of mixture, and finds extensive application in concrete mixer. Japanese Laid-Open patent application No. 48-30149 laid open on Apr. 20, 1973 (or counterpart German Application DE OS No. 2,141,908) discloses a typical dual shaft pan mixer which is currently used as a concrete mixer. A mixer of such type comprises a pair of paddle assemblies associated with a first and a second pan section having a cross-sectional configuration of a pair of hollow cylinders joined transversely to each other. The pair of paddle assemblies are disposed horizontally and in parallel relationship with each other, and rotate in opposite directions. Each of the paddle assemblies comprises a shaft which is rotatably mounted in its associated pan section and a plurality of paddles fixedly and rigidly mounted on the shaft. Each paddle includes an arm and a shovel, and is angularly offset 90° with respect to adjacent paddles. The pair of paddle assemblies depict loci of rotation which partly overlap each other. The paddle assemblies are both accordingly driven synchronously either mechanically or electrically, whereby a mixture is driven reciprocately between one of the pan sections and the other.

Normally, a discharge port is defined below and intermediate the pair of pan sections of the mixing vessel, and a slide valve or shutter is mounted therein for opening or closing the port. Because of such construction of the discharge port, a region located intermediate the pair of pan sections creates a substantially triangular dead space. Such dead space has been believed according to the recognition of the prior art to be useful to guard the structure of the discharge port from abrasion which may result from a rapid movement of the mixture which is being mixed. However, the inventors have found that a temporary stagnation of the mixture in the dead space prevents an overall high mixing performance.

It is already known that the application of vibrations to the mixture which is being mixed contributes to improving the mixing performance, and U.S. Pat. No. 4,148,588 issued Apr. 10, 1979 to the present inventors and entitled "Pan mixer" discloses a rotating pan mixer in which longitudinal vibrations are applied to a fixed paddle assembly which is disposed within the rotating pan.

SUMMARY OF THE INVENTION

It is an object of the invention to provide a dual shaft pan mixer having improved fluidity of mixture and mixing performance and which is capable of achieving a uniform mixing within a reduced length of time.

It is a specific object of the invention to provide a dual shaft pan mixer including a vibrator which applies vibrations to the mixture which is being mixed.

In accordance with the invention, there is provided a dual shaft pan mixer comprising a mixing vessel including a first and a second pan section, a pair of paddle assemblies disposed horizontally and in parallel relationship with each other within the mixing vessel so as to be associated with each of the pan sections and having drive shafts which are driven for rotation in opposite directions, and a drive source for synchronously driving the pair of paddle assemblies. The mixing vessel includes a substantially triangular space intermediate and below the first and the second pan section and located out of the loci of rotation of the pair of paddle assemblies. It includes a discharge port disposed adjacent to the space. The dual shaft pan mixer of the invention additionally includes rod-shaped vibrator means disposed within the space and extending in a direction parallel to the drive shafts. The rod-shaped vibrator means is effective to apply vibrations to a mixture which is alternately driven into the space as a result of the mixing operation by the pair of paddle assemblies.

DESCRIPTION OF PREFERRED EMBODIMENT

Figure 1:
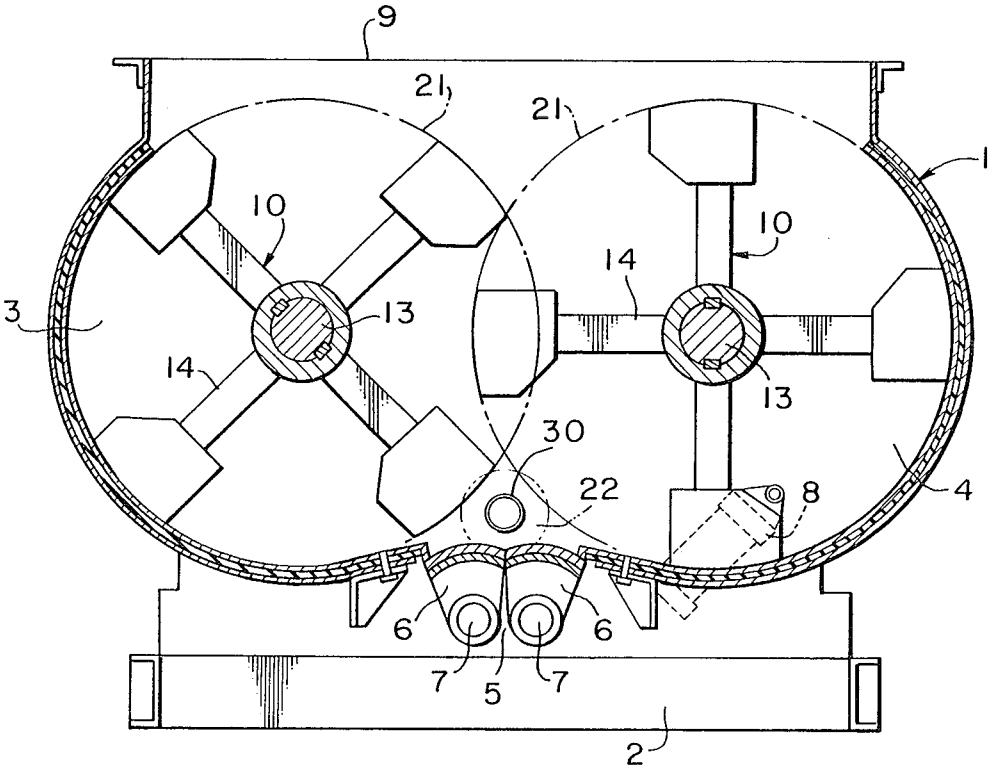
FIG. 1 is a cross section of a dual shaft pan mixer according to the invention.
Figure 2:
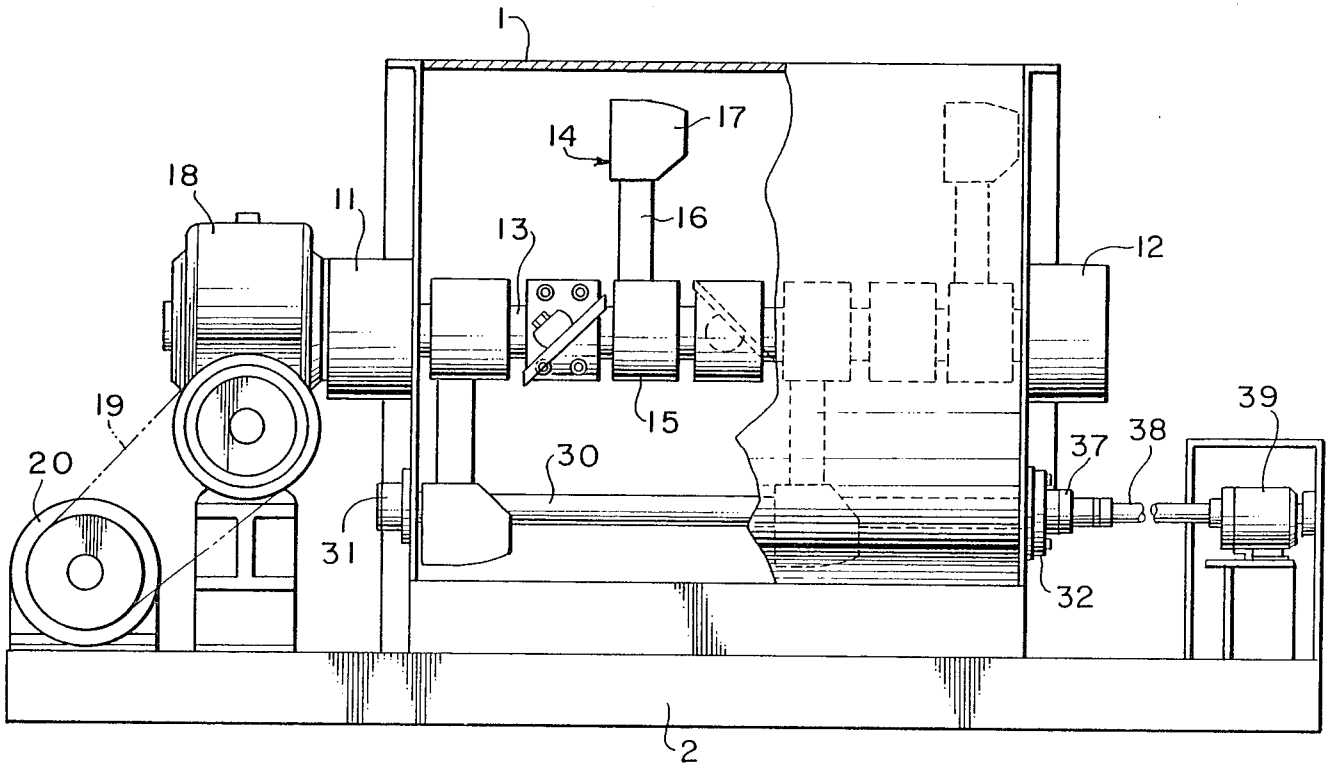
FIG. 2 is a side elevation of the pan mixer shown in FIG. 1, partly broken away.

Referring to FIGS. 1 and 2, a dual shaft pan mixer includes a mixing vessel 1 which is mounted on a base 2. As viewed in cross section, the mixing vessel 1 comprises a pair of hollow cylinders laterally joined together, and internally defines a first pan section 3, and a second pan section 4. A discharge port 5 is formed below an intermediate regions between the both pan sections 3, 4 and a pair of shutter members 6 are mounted on the base 2 so as to be operatively associated with the discharge port 5. Each shutter member 6 is fixedly mounted on a separate crankshaft 7 so as to open or close the port 5 as the crankshaft 7 rotates. The crankshaft 7 may be driven by an air cylinder 8, which is illustratively shown for one of the crankshafts 7 alone. The top of the vessel 1 may be left open so as to form an introduction opening, or may be connected to an inlet duct of known form.

A pair of paddle assemblies 10 are disposed horizontally and in parallel relationship with each other so as to be operatively associated with each of the pan sections 3 and 4 of the vessel 1. Each of the paddle assemblies 10 comprises a drive shaft 13 which is rotatably carried by bearings 11, 12 mounted on the vessel 1, and a plurality of paddles 14 which are fixedly and rigidly mounted on the shaft. Each paddle 14 includes an arm 16 which is secured to the boss 15 of the shaft 13 and a shovel 17. It is to be noted that adjacent paddles are angularly offset by 90°. As is well known, the pair of paddle assemblies 10 is mechanically connected to a common worm gearing 18, which is adapted to be driven by an electric motor 20 through a V-belt 19. The pair of paddle assemblies 10 are synchronously driven for rotation in mutually opposite directions so that their loci of rotation 21 partly overlap each other.

It will be noted that a space 22 having a substantial length and which is substantially triangular in section is defined adjacent to discharge port 5 and displaced out of the loci of rotation of the paddle assemblies 10 in a region between both pan sections 3 and 4 of the vessel 1. In accordance with the invention, a rod-shaped vibrator 30 is disposed in the space 22. The rod-shaped vibrator 30 is disposed between and extends parallel to the both paddle shafts 13, and is formed by a kind of eccentric vibrator which has its opposite ends carried by a pair of resilient support members 31, 32 mounted on the bottom of the vessel 1.

Figure 3:
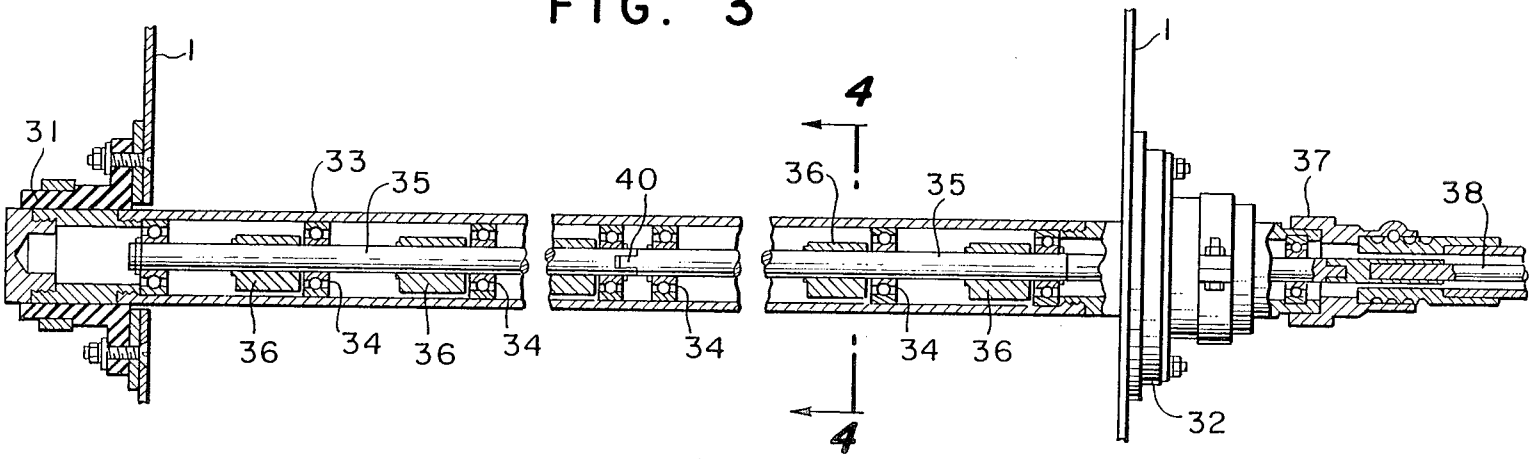
FIG. 3 is a cross section of a rod-shaped vibrator shown in FIGS. 1 and 2.
Figure 4:
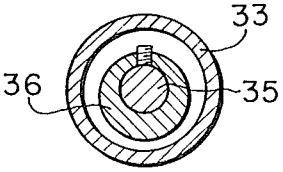
FIG. 4 is a cross section taken along the line 4—4 shown in FIG. 4.

Referring to FIGS. 3 and 4, the vibrator 30 comprises a sleeve 33 formed of a hard metal and carried by the pair of resilient support members 31, 32, a plurality of bearings 34 which are secured within the sleeve 33, a drive shaft 35 which is rotatably carried by these bearings 34, and a plurality of eccentric unblanced weights 36 which are fixedly mounted on the shaft 35. The drive shaft 35 is connected through a coupling 37 to a flexible rotation transmitting shaft 38, which is in turn driven by an electric motor 39. As the drive shaft 35 is driven for rotation by the motor 39, under the influence of the centrifugal force of the plurality of eccentric weights 36 mounted on the shaft, the vibrator 30 causes the sleeve 33 to vibrate with amplitudes in a direction perpendicular to the axis of the shaft. The vibrations applied over the entire length of the sleeve 33 will be most effective when the eccentric weights 36 are mounted on the shaft 35 so as to be angularly aligned.

It is a feature of the invention that the rod-shaped vibrator 30 is disposed in the substantially triangular space 22 left between the pair of pan sections 3, 4 and out of the loci of rotation of the pair of paddle assemblies 10. As a result of such arrangement, the vibrator 30 applied oscillations to a mixture which is alternately driven into the space 22 by the action of the respective paddle assemblies 10, thereby promoting a dispersion of cement particles throughout the mixture and assisting in the adhesion of the cement particles to the water with a resulting high mixing performance which is achieved within a reduced length of time. Because the fluidity of the mixture is improved, the individual paddle will be subject to impacts of reduced magnitudes, thus aiding in the reduction of the drive power.

In a preferred embodiment, the vibrator 30 rotates with a number of revolutions which is approximately 5,000 rpm, and the amplitude as measured at the axial center of the vibrator was 2 mm while the amplitude adjacent to the opposite ends was 0.4 mm. Where a rod-shaped vibrator of an incresed length is used for a mixer of an increased capacity, it is desirable that a first and a second drive shaft 35 be connected together through a cruciform joint 40 as shown in FIG. 3. by experimental result, it is found that a concrete mixer which incorporates the rod-shaped vibrator according to the invention improves the compressive strength of concrete by an amount approximately 10 to 15% over the product of a conventional dual shaft pan mixer which does not utilize such rod-shaped vibrator.

What is claimed is:

1. A dual shaft pan mixer comprising a mixing vessel including a first and a second pan section, a pair of paddle assemblies having drive shafts which are disposed horizontally and in parallel relationship with each other within the mixing vessel and adapted to rotate in mutually opposite directions, and a drive source for synchronously driving the pair of paddle assemblies, the mixing vessel having a substantially triangular space below a region intermediate the first and the second pan section and displaced out of the loci of rotation of the paddle assemblies, the vessel having a discharge port located adjacent to the space, further comprising rod-shaped vibrator means disposed within the space and extending in a direction parallel to the drive shafts, the vibrator means being effective to apply vibrations to a mixture which is alternately driven into the space as a result of a mixing operation by the paddle assemblies.

2. A dual shaft pan mixer according to claim 1 in which the rod-shaped vibrator means comprises a pair of resilient support members fixedly mounted on the mixing vessel, an elongate, rigid sleeve having its opposite ends carried by the pair of resilient support members, a plurality of bearings which are spaced apart within the sleeve, a shaft rotatably mounted in the bearings, a plurality of distributed eccentric weights which are aligned with each other at a given mounting angle on the shaft, a drive source for driving the shaft for rotation, and a rotation transmitting member which provides a connection between the shaft and the drive source.

3. A dual shaft pan mixer according to claim 2 in which the rotation transmitting member comprises a flexible rotation transmitting shaft.

4. A dual shaft pan mixer according to claim 2 in which the shaft comprises a first and a second portion which are coupled together by a cruciform joint.

* * * * *